US005331747A

United States Patent [19]

Stanton

[11] Patent Number: 5,331,747

[45] Date of Patent: Jul. 26, 1994

[54] HYDRAULIC TEST APPARATUS AND METHOD FOR STATOR IN ELECTRICAL GENERATOR

[75] Inventor: Douglas J. Stanton, Schenectady, N.Y.

[73] Assignee: General Electric Company, Schenectady, N.Y.

[21] Appl. No.: 76,156

[22] Filed: Jun. 14, 1993

Related U.S. Application Data

[63] Continuation of Ser. No. 845,714, Mar. 4, 1992, abandoned.

[51] Int. Cl.[5] ..... F26B 5/04

[52] U.S. Cl. ..... 34/405; 34/104; 15/407

[58] Field of Search ..... 34/15, 92, 51, 104; 15/300.1, 304, 316.1, 319, 406, 407

[56] References Cited

U.S. PATENT DOCUMENTS 4,986,008 1/1991 Falk .
5,133,136 7/1992 Sykora .

OTHER PUBLICATIONS

"Removal of Water From a Water-Cooled Generator Stator", Bristor, Sep. 19, 1968 (General Electric; 348HA607).
"Removing Water From Liquid Cooled Stator Windings", Racko, Jun. 6, 1978 (General Electric; P24A-A-L-5035).
"Automatic Blowdown Procedure", Luther, May 18, 1978 (General Electric).
"Generator Inspection & Test Manual", ES-STM--E3.1, Jun. 1, 1984 (General Electric).

*Primary Examiner*—Henry A. Bennett
*Attorney, Agent, or Firm*—Nixon & Vanderhye

[57] ABSTRACT

A hydraulic testing and drying apparatus for a water cooled-stator in an electrical generator. The apparatus is mounted on a sled (10) and comprises an air compressor (16), regenerative air dryer (18), receiver (20), vacuum pump (22) and associated piping and control devices. After the receiver is coupled to the inlet to a stator winding, dry and clean compressed air pressurizes the receiver and stator winding. Pressure activates valves between the compressor and receiver, and at the drain of the stator winding operate so that the pressurized air purges moisture from the stator windings. Through the use of pressure activated switches, cycles of pressurization and purging are run automatically. Hygrometer sensors monitor the dewpoint of the air entering the generator and of the air exhausting from the generator. A vacuum pump (22) creates a vacuum within the stator winding to complete drying and to test the decay of a vacuum in the stator windings.

23 Claims, 4 Drawing Sheets

HYDRAULIC TEST APPARATUS AND METHOD FOR STATOR IN ELECTRICAL GENERATOR

This is a continuation of application Ser. No. 07/845,714, filed Mar. 4, 1992, now abandoned.

FIELD OF THE INVENTION

This invention is related to methods and apparatus for testing water cooled stators in electrical generators. In particular, this invention relates to a method and apparatus for efficiently drying water cooled stators, and for conducting hydraulic and electrical tests of these stators.

BACKGROUND AND PRIOR ART

Large power generators have water cooled stator windings. These windings require regular maintenance and testing for electrical and hydraulic leaks. These tests require the stator winding to be completely dry. However, it is extraordinarily difficult to dry stator windings.

Electrical tests, such as insulation resistance and electrical overpotential, can only be reliably undertaken when the stator is entirely free of moisture. The electrical test results will be inaccurate if the winding is damp. In addition, a water cooled stator receives hydraulic testing approximately every two and one/half years. Hydraulic tests detect water leaks within the stator winding by evaluating the ability of the winding to hold vacuum and pressure.

Prior methods of drying water-cooled stators and conducting hydraulic tests were difficult and time consuming. For example, the methods employed in a generator factory begin by draining the winding by gravity. However, about 10% to 30% of the water in the stator will not drain by gravity due to a manometer effect.

To remove the remaining water, an air hose is connected to the water inlet on the generator winding. The other end of the air hose is connected to an air manifold having an air actuated valve to control air flow. The manifold is itself connected to a receiver through which compressed air from the factory is supplied.

To dry the stator windings in the factory, shop compressed air first fills the receiver and manifold. Once the receiver is pressurized, the air actuated valve on the manifold is opened and compressed air flows into the generator, through the stator windings and out the open drain valve. The flow of air forces out some of the remaining moisture in the stator. After the compressed air exhausts from the receiver, the manifold valve is closed, and the receiver is again filled with compressed air to repeat the drying cycle. This cycle is repeated until all moisture is purged from the generator.

The factory method of drying a stator is disadvantageous because shop compressed air often has contaminants such as oil, water, and rust. These contaminants get caught in and can harm the stator windings. Moreover, moisture introduced into the stator by the shop air undermines the drying process. To purge all of the moisture from the stator, bottled nitrogen has been used to blow nitrogen through the stator windings for about an hour following the blow down with air. Bottled nitrogen is generally cleaner and dryer than the factory compressed air, and is useful for final drying. In addition, a vacuum has been created in the stator windings to boil off and draw out any remaining moisture.

In these prior methods, moisture in the air exhausting from the stator is visually monitored to determine when the stator is finally dry. However, no reliable method of evaluating the moisture in the exhaust air was available in the past. Because of the inherent inaccuracy in this method of determining stator dryness, procedures have been followed in the past in which air is blown through the stator for 12 to 16 hours before any hydraulic or electrical tests are attempted. These procedures are uncertain and wasteful. If the stator is dry in the first 8 or 10 hours, then the remaining time of the procedure is wasted and expensive down time. On the other hand, if the winding is not dry, then time can be wasted in attempting unsuccessful electrical and/or hydraulic tests.

Field testing and drying a generator is even more difficult than factory testing. Prior methods of drying water cooled stator windings in the field are similar to factory drying methods in that water in the stator is first allowed to drain out under the force of gravity. The compressed air available at the site, which often has more moisture and contaminants than does factory shop air, is connected to the inlet port piping on the generator.

In prior field methods, to pressurize the stator a valve on the outlet drain piping is manually closed. The shop air fills the stator winding. When a selected air pressure is reached in the winding, the outlet valve to the generator drain is manually opened to expel moisture out of and relieve the pressure in the winding to atmospheric pressure. Then, the outlet valve is again closed and the winding allowed to refill with pressurized shop air. Once the selected high pressure is reached, the outlet valve is again opened to expel moisture and exhaust pressure. This process is repeated until the exhaust gas appears to be free of moisture. However, the stator winding has a minimal internal passage volume and, thus, cannot hold much pressurized air. A large volume of pressurized air is needed to blow out the moisture in the stator. Accordingly, the air flow is reversed within the stator from time to time during this process by connecting the shop air to the outlet drain so as to purge moisture from the inlet header side of the winding.

This field method of purging moisture from a stator winding has the same disadvantages as does the method used in the factory. In addition, the field method lacks a compressed air receiver to store a large volume of compressed air that is repeatedly purged through the winding. In the field, the compressed air is stored only in the smaller volume of the stator windings. Thus, the amount of air passing through the winding during each cycle is less in the field than it is in the factory where a receiver is used. Moreover, air at the inlet end of the generator is not pushed completely through and out the exhaust end of the generator. Accordingly, a time-consuming procedure to reverse the air flow is needed in field operations to purge all moisture out of both ends (and throughout) of the stator windings.

SUMMARY AND ADVANTAGES OF THE INVENTION

The present invention includes a source of super dry, compressed air provided by an oil-flooded, air-cooled rotary screw compressor coupled to desiccant drying medium. The clean, dry air fills the stator winding and a receiver having a pressure activated valve in the piping connected to the stator inlet. A similar pressure activated valve is connected to the stator drain. Through the automatic operation of these valves, the receiver and stator are both automatically filled with pressurized air. Then, this pressurized air is allowed to blow out the moisture from the stator windings. This cycle is automatically repeated until the stator is dry.

Another advantage of the invention is that a low pressure valve actuation pressure may also be set. This allows the blow down process to operate between two desired pressures (high and low). It has been found that by closing the drain valve before winding pressure reaches zero, some pressure, e.g., 20 p.s.i. below the high pressure setting, can be saved in the stator winding. Because some pressure remains in the winding, less time is required to repressurize the stator to the desired high pressure. This time reduction saves time on the overall drying process.

Another advantage of the invention is that the dryness of the stator winding is measured by comparing the air dew point at the generator inlet to that at the generator drain. A vacuum system is also included in the present invention for the vacuum decay tests and final stator drying. The vacuum pump connects to the generator using the same coupling as used by the compressed air system. In addition, the present invention has control panels for operating and monitoring the drying of the stator winding for and conducting the pressure and vacuum decay tests.

It is an objective and advantage of the present invention to provide a self-contained apparatus and method of drying stator windings and associated piping in the generator so that pressure and vacuum decay, and electrical testing can be reliably undertaken on a dry stator winding. Similarly, it is an objective and advantage of the invention to purge moisture from stator windings using super dry, compressed air followed by forming a good vacuum in the winding to remove any remaining moisture in the winding which was not removed by blow down process. In addition, it is an objective and advantage of the invention to provide a self-contained unit for drying stator windings, and for conducting pressure and vacuum decay tests on stator windings.

In addition, it is an objective and advantage of this invention to apply both the capacity of a pressurized air receiver and of the stator winding to automatically blow air through stator windings in a series of cycles.

The present invention is characterized as a stator hydraulic test and dryer apparatus comprising:

an air compressor having a compressed air outlet operatively coupled through at least one filter to an inlet to a air dryer having an outlet operatively coupled to an inlet to a receiver, wherein a first automatic valve is positioned to isolate the compressor from the receiver when closed;

the receiver being operatively coupled to an inlet to water-cooled stator windings so that compressed air in the receiver passes into the stator windings;

a second automatic valve coupled to the stator winding drain for the generator; and wherein the first automatic valve being opened and the second automatic valve being closed until the pressure in the receiver and stator windings reaches a predetermined level, at which point said first automatic valve is closed and the second automatic valve is opened to purge moisture and pressurized air from said receiver and stator windings, the first automatic valve being opened and the second automatic valve being closed when the air pressure in the receiver and stator windings falls to a preselected level. The low pressure level can be adjusted to improve the efficiency of the blow down process.

Similarly, the method of the present invention can be characterized as a method for automatically drying stator windings using an air compressor, air dryer, receiver and automatic pressure activated valves, said method comprising the steps of:

a. automatically opening a first pressure activated valve between the receiver and air compressor and automatically closing a second pressure activated valve at the drain of stator windings of the generator, when the pressure in the receiver or stator falls to a predetermined pressure;

b. providing compressed air from the air compressor via the air dryer to the receiver which passes compressed air into the stator windings of the generator;

c. pressurizing the receiver and stator windings with compressed air;

d. when the pressure in the receiver or stator reaches a predetermined level, automatically closing the first pressure activated valve to isolate the receiver from the compressor and opening the second pressure activated valve to exhaust moisture and compressed air from the stator windings and receiver, and e. repeating steps a through d until the stator windings are relatively dry.

DETAILED DESCRIPTION OF THE DRAWINGS

Figure 1:
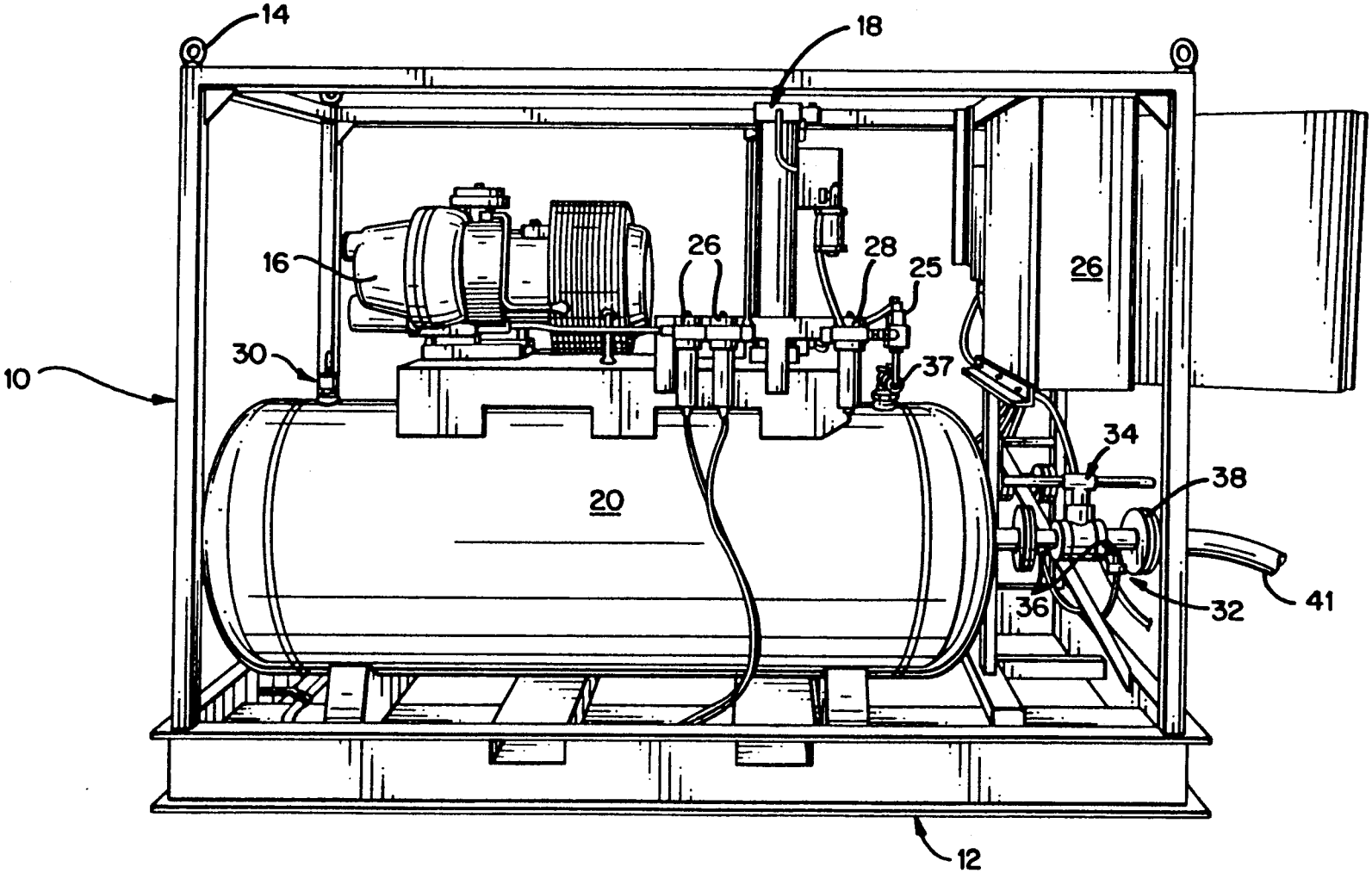
FIG. 1 is a side view of the stator hydraulic test set with dryer apparatus of the present invention.
Figure 2:
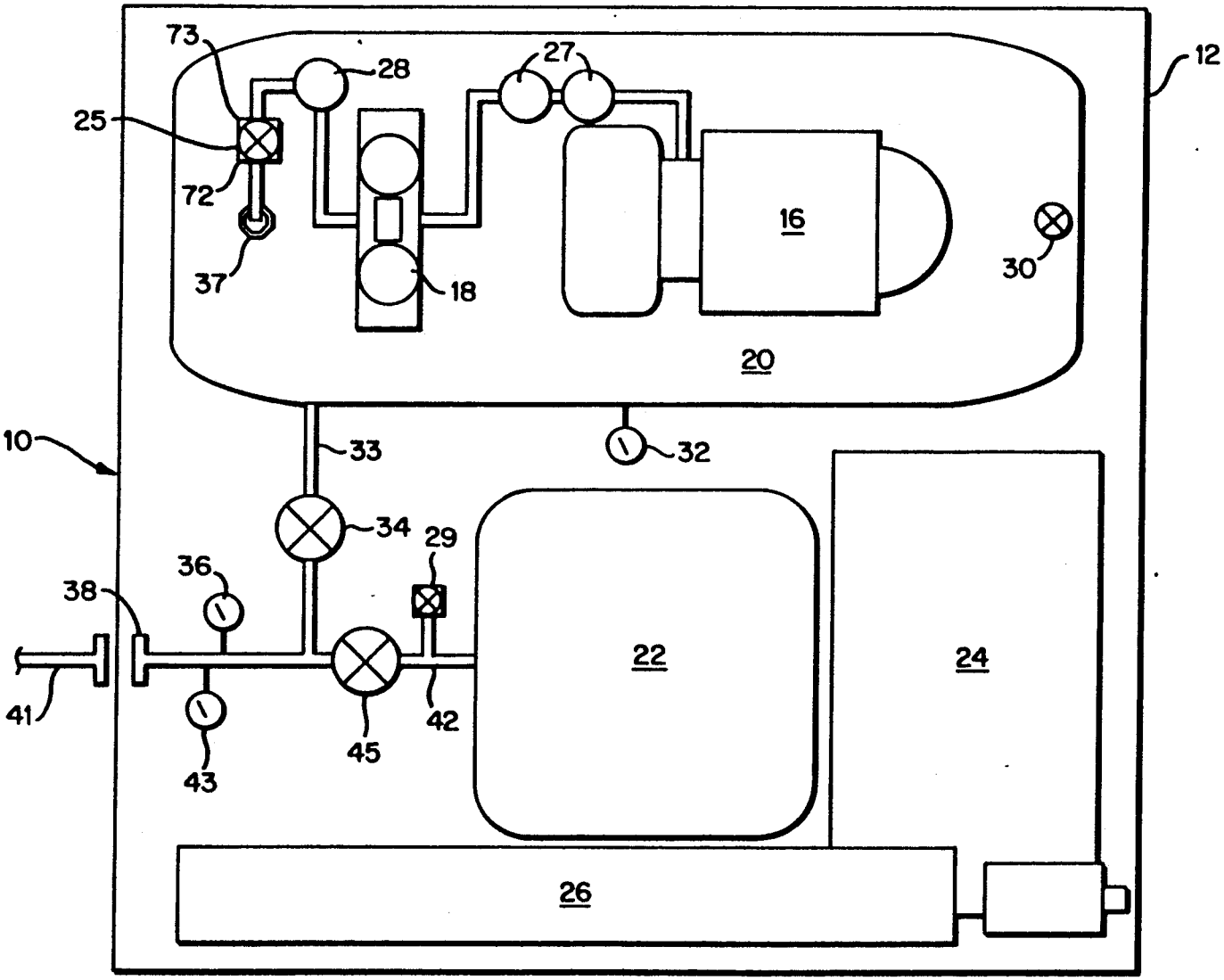
FIG. 2 is a top view of the apparatus shown in FIG. 1.

FIGS. 1 to 4 illustrate a hydraulic test set with dryer comprising a rectangular and open sled 10 housing all of the components of the dryer and test apparatus 12. Mounted within the sled are an air compressor 16, regenerative air dryer 18, receiver 20, vacuum pump 22, storage box 24 and control panel 26. Air shock absorbers (not shown) are attached to the base of the sled to isolate the sled from vibration during transportation. The sled also has eyelets 14 so that the sled can be crane lifted and transported. Because of the sled, the test set and dryer can be transported within the factory or out into the field to any generator.

The air compressor 16 may be an oil-flooded, air-cooled rotary screw compressor of the type manufactured and sold by the Sullair Corporation of Michigan City, Ind. as a Sullair® 6E Series compressor. Compressed air from the compressor is passed through a control solenoid valve 25 and a filter pair 27 that includes a prefilter for removing particles greater than 1.0 micron and then a coalescing filter for removing particles greater than 0.01 micron. The prefilter may be of the type of the Sullair® MPF Mini-Puretech Filter and the coalescing filter may be of the type of the Sullair® MPH Mini-Purelescer Filter, both of which are available from the Sullair Corporation. These filters have a borosilicate microfiber filter medium.

All piping for the compressed air is stainless steel downstream of the coalescing filter. After the filter pair, the compressed air is dried in the regenerative air dryer 18 of a type that is a twin-tower PNEUMATECH, INC. MINI-SERIES dryer or a Sullair® SAR dryer. The regenerative dryer uses a desiccant drying medium to remove moisture from the compressed air and lower the air dew point to −40 degrees Fahrenheit in the preferred embodiment. Thereafter, the compressed air passes through an after filter 28, e.g. a Sullair® MPF Mini-Puretech Filter, to remove the desiccant medium from the air.

Super dry and super clean compressed air exits the after filter 28. This compressed air passes through a hygrometer sensor 37 and enters the receiver 20 which holds a large volume, e.g. 200 gallons, of compressed air until released through the generator. The hygrometer sensor and associated hygrometer display 65 may be of the type of a Kahn Series 1000E Dewpoint Hygrometer sold by Kahn Instruments Incorporated of Wethersfield, Conn. The receiver can be of the type manufactured and sold by the Sullair Corporation. The receiver has a pressure activated safety valve 30 to relieve excess or unsafe air pressure. In addition, the receiver has a liquid filled gauge 32 to provide a failsafe positive reading of the pressure within the receiver.

Air from the receiver flows through piping 33 having a precision-ball manual valve 34 and two pressure sensing probes 36. The piping terminates at an air pressure/-vacuum outlet flange 38. Coupled to this flange is a hose 41. The matching flange 40 on the hose allows easy coupling to the flange 38 to the pressure/vacuum connection. The other end of the hose attaches to the inlet header 44 on the generator 46. Coolant passages in the generator couple the inlet header 44 to the water cooled stators 47. The hose and its attachments are conventional and suited to both vacuum and pressure testing.

The vacuum drying/test system comprises an oil-sealed rotary piston compound vacuum pump 22. This vacuum pump can be of the type manufactured and sold as a KTC-60 by the Kinney Vacuum Company of Canton, Mass. Stainless steel piping 42 couples the pressure/vacuum inlet to the vacuum pump. In this piping are two vacuum sensors 43, e.g. of the thermocouple type, and a manual precision-ball valve 45.

The operation of the dryer and hydraulic test apparatus can be controlled from the control panel 26. The panel houses all of the electrical components, operating switches and monitor displays for the testing and drying apparatus 12. A power breaker 52 turns the power on and off to the apparatus. Mode switch 55 allows the operator to switch between the drying cycle and testing for both the compressor and vacuum pump. In addition, selector switches 53 allow power to be selectively applied to the compressor and vacuum pump. Indicator lights 54, 56 shine when power is applied to their respective compressor or vacuum pump. A similar indicator light 58 indicates which dryer tower 18 is in use. Moreover, a large emergency stop/reset button 57 and emergency stop lights 59 are included on the control panel.

Figure 3:
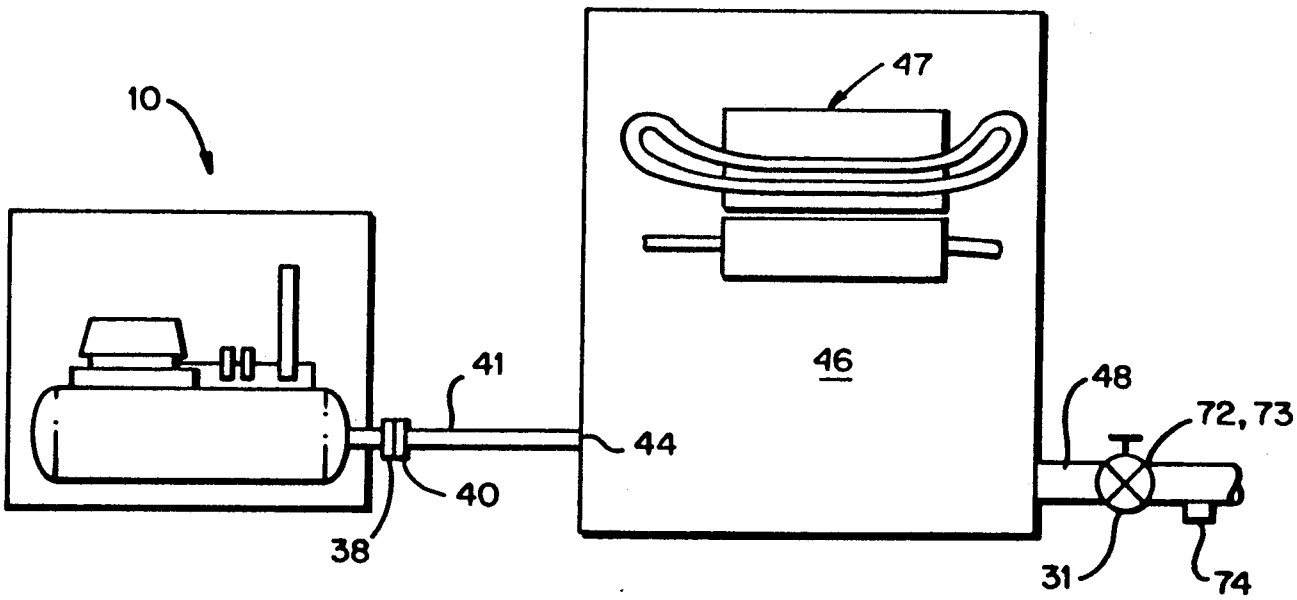
FIG. 3 is a sketch of the test set with dryers, generator and drain line from the generator.
Figure 4:
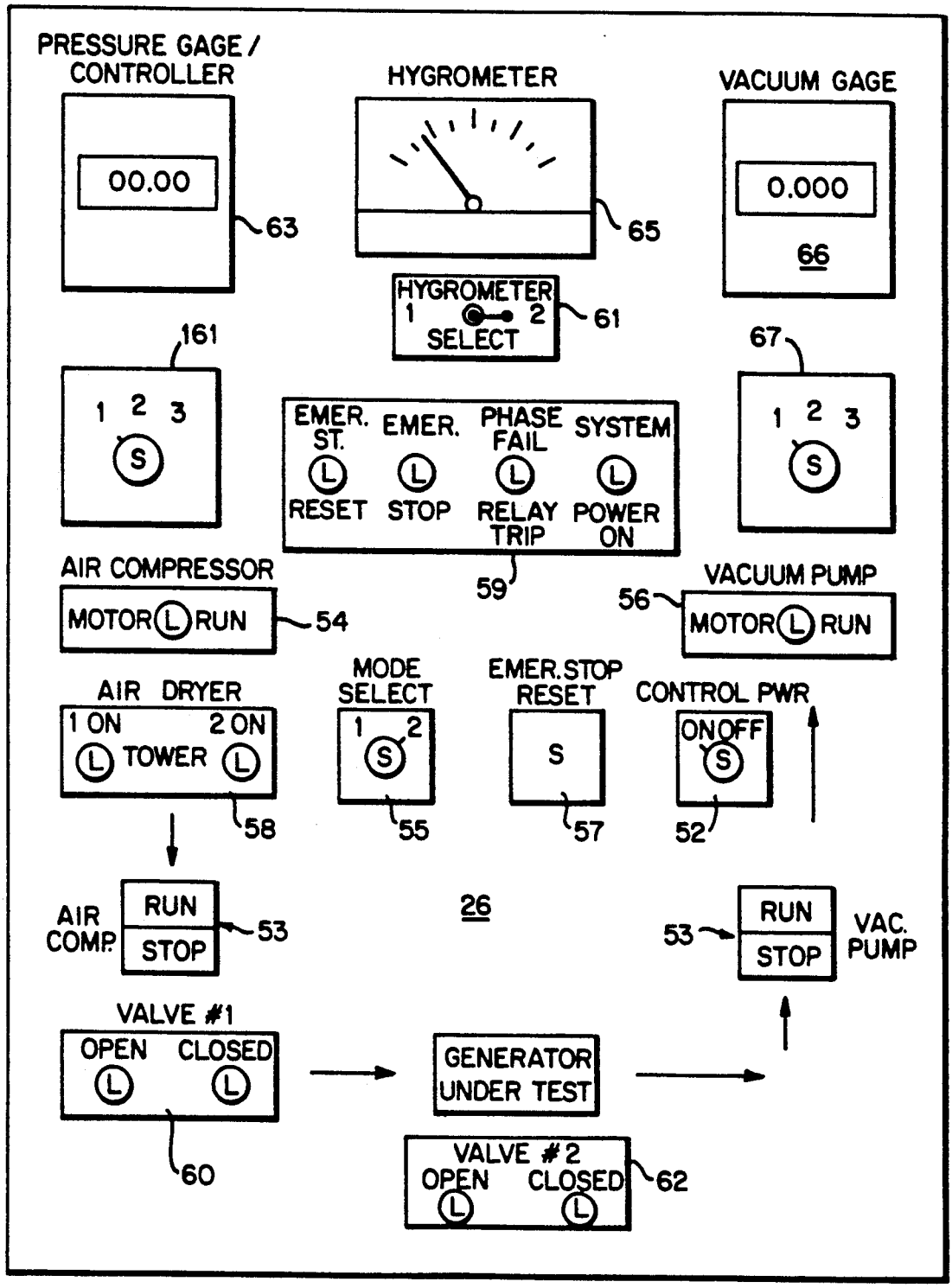
FIG. 4 is a detailed illustration of a portion of the control panel shown in FIG. 2.

When power is applied to the compressor, the control solenoid 25 at the receiver inlet is opened to allow compressed air to flow into the receiver 20 and the stator winding. The receiver and winding are pressurized with compressed air. A first pressure responsive switch 72 (symbolized by valve displays 60 and 62) operatively coupled to the pressure sensors 36 closes the control solenoid valve 25 when the air pressure in the receiver reaches a predetermined level. Upon closing this solenoid valve, the receiver is isolated from the compressor. In addition to closing the solenoid valve, the first pressure responsive switch 72 also automatically opens (energizes) a remote control solenoid 31 (symbolized by valve display 62) coupled to the drain pipe 48 on the generator (FIG. 3). Thus, the first pressure responsive switch 73 both isolates the compressor and opens the drain piping to allow pressurized air in the receiver and stator windings to blow moisture out of the stator winding through the generator drain.

A second pressure activated switch 73 (symbolized by valve displays 60 and 62) also is operatively coupled to pressure sensors 36 and opens the first control solenoid 25 when the air pressure in the line from the receiver drops below a predetermined pressure level. This second switch also simultaneously closes the control valve 31 at the drain of the generator. Thus, when the second switch activates, the compressor begins to refill both the receiver and stator winding with compressed air. The operation of the two pressure activated switches sets up a drying cycle for the stator winding whereby the windings and receiver are repeatedly filled with compressed air that is then used to blow moisture out of the stator windings.

The lighting sequence of indicators 60 and 62 on the control panel shows the operation of the drying cycle. Indicator light 62 shows the position of the solenoid valve 31 at the generator exhaust. Light 60 shows the position of valve 25 at the receiver inlet. The pressure gauge 63 displays the pressure levels as being measured by each of the pressure sensors 36. The operator selects the pressure sensor to be displayed using switch 161. The operator monitors these indicator lights, gauges and the hygrometer display 65 for the hygrometer sensor 37 at the receiver inlet and the hygrometer sensor 74 at the drain of the generator. A hygrometer select switch 61 allows the operator to monitor both hygrometer sensors. When the difference in dewpoint between the air exiting the receiver (and entering the generator header) and that of the air exiting the generator falls to some preselected value, then the blow down of the stator windings is completed.

The operator then activates selector switch 53 to switch power from the compressor to the vacuum pump. A vacuum is created in the stator winding to boil off and draw out any remaining moisture in the generator.

A display light 56 in the control panel indicates when the vacuum pump is operating. A safety solenoid valve 29 opens the vacuum pump to atmosphere whenever the pump is not powered. Deenergyzing this solenoid and thereby opening the valve to the atmosphere prevents a vacuum in the inlet piping from pulling the oil out of a deenergized pump.

The vacuum pump creates a vacuum within the stator windings. The amount of vacuum created in the stator winding is indicated on a vacuum display gauge 66 on the control panel. This gauge has a channel for each of the two vacuum sensors 43 in the vacuum inlet line. The vacuum sensor to be displayed on the gauge is selected by switch 67.

On a panel (not shown) adjacent the control panel are two timer meters. One timer tracks the cycle timing for drying the stator, and hydraulic decay testing. The other timer operates whenever power is applied to the control panel and serves to record the operating service time of the dryer and test unit. Moreover, power to the control panel comes through a breaker panel (not shown) on the sled 10 that steps down the voltage via a transformer to the proper voltages for the electrical components on the sled. Thus, a standard electrical power coupling is used to connect the sled to an standard electrical power source. This standard coupling can be easily connected to a local power source.

In operation, water is removed from the water-cooled stator by blowing super-dry, compressed air through the stator windings and associated piping. Because the pressure and release cycles necessary to dry the windings are automatically controlled, the man hours needed to dry and test the windings are substantially reduced.

The basic operating procedure begins after the windings are drained by gravity and when the operator connects the compressed air feed hose 41 to the pressure/-vacuum outlet flange 38 and the other hose end to the inlet header 44 on the generator (FIG. 3). Similarly, a remote control solenoid drain valve 31 and hygrometer 37 are attached to the drain line from the generator. The operator sets the minimum and maximum pressures for the drying cycles via the control panel. Once started, the apparatus automatically conducts the drying cycles to purge moisture from the stator windings.

The operator monitors the dryness of the winding by comparing the dewpoint of the inlet and exhaust air to and from the winding. The dewpoint is the temperature at which the water vapor pressure in the air equals the saturated water vapor pressure. It is the temperature at which water vapor will just begin to form condensation. Dewpoint is a fundamental unit and is directly equivalent to water vapor pressure in parts per million. Thus, it is a convenient measure of actual water content of air because the dewpoint is not a function of temperature in the same way that is relative humidity.

The comparison of dew points provides a reliable indication of the moisture in the stator windings. When the difference between dew points reaches some selected criteria, then the operator knows that the stator winding is relatively dry and terminates the blow down drying cycle procedure.

Upon completion of the blow down, valve 34 to the receiver is closed and valve 45 to the vacuum pump 22 is opened. A vacuum is formed in the stator winding to boil off any remaining moisture and to completely dry the generator.

Once the stator winding is completely dry, the hydraulic tests are conducted. The pressure decay test employs the same air compressor system that dried the stator. Once the generator has been pressurized, the generator is isolated by closing inlet and outlet valves 34, 31. In the preferred embodiment, the stator winding is pressurized to approximately 90 psi. The pressure in the winding as measured via pressure sensors 36 is recorded during the test period. These pressure measurements are the test data of the pressure decay. This data is later evaluated to determine the condition of the stator windings and generator.

The vacuum pump 22 can reduce the pressure in the winding sufficiently, e.g. to less than 50 microns, to conduct the vacuum decay test. Power is applied to the vacuum pump and the control solenoid 29 is energized to isolate the vacuum pump from the atmosphere. Similarly, the remote solenoid valve 31 is closed to isolate the stator windings from the atmosphere through the drain. The vacuum pump evacuates the stator winding to a desired pressure. The vacuum level is less than 50 microns, in the preferred embodiment. The decay of the vacuum in the stator is monitored and recorded for a certain period of time using the vacuum sensors 43. In this way, the data from the vacuum decay testing is obtained for future analysis.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator hydraulic test and dryer apparatus comprising:

an air compressor operatively coupled to an air dryer operatively coupled to a receiver, wherein a first automatic valve is positioned to isolate said compressor from said receiver when closed;

said receiver being operatively couplable to a first port of a water-cooled stator winding so that compressed air in said receiver passes into said stator winding;

a second automatic valve couplable to a second port of the stator winding;

a pressure activated switch being operatively coupled to activate the first and second automatic valves in response to at least one pressure sensor in said receiver or stator winding, and wherein said first automatic valve being opened and said second automatic valve being closed until the pressure in said receiver and stator windings reaches a predetermined high level, at which point said first automatic valve is closed and said second automatic valve is opened to purge moisture and pressurized air from said receiver and stator winding, said first automatic valve being opened and said second automatic valve being closed when the air pressure in said receiver and stator winding falls to a predetermined low level, wherein said predetermined low level is significantly above atmospheric pressure.

2. A stator hydraulic test and dryer apparatus as in claim 1 further comprising hygrometer sensors, one of said sensors being positioned to monitor the compressed air entering the generator and a second of said sensors being positioned to sense the air exhausted from said generator, and a hygrometer indicating the comparative dew points of the compressed air entering the generator and that of the air exhausted from the generator.

3. A stator hydraulic test and dryer apparatus as in claim 1 further comprising a pressure outlet flange at a compressed air outlet of said apparatus, said outlet flange being also a vacuum inlet flange coupled to a vacuum pump in said apparatus.

4. A stator hydraulic and dryer apparatus as in claim 1 wherein said air compressor, air dryer, receiver, and first automatic valve are mounted in a sled.

5. A method for automatically drying a stator winding in a generator using an air compressor, air dryer, receiver and at least one automatic pressure activated valve, said method comprising the steps of:

a. providing compressed air from the air compressor via the air dryer to the receiver which passes compressed air into the stator windings of the generator, b. pressurizing the receiver and stator winding with compressed air;

c. when the pressure in the receiver or stator reaches a predetermined high level, automatically opening the pressure activated valve at an air outlet port for the stator winding to exhaust moisture and compressed air from the stator winding and receiver, d. automatically closing the pressure activated valve when the pressure in the receiver or stator falls to a predetermined low pressure substantially above atmospheric pressure, and e. repeating steps a through d to dry the stator winding.

6. A method for drying a stator as in claim 5 further comprising a hygrometer with sensors monitoring the compressed air before it enters the generator and where the air exhaust the generator and further comprising the following step:

f. comparing the dewpoint as sensed by the hygrometer sensors of the compressed air entering the generator and the air exhausting from the generator and concluding the drying method after the difference between the dew points is less than a selected value.

7. A method for drying a stator as in claim 5 further comprising the steps of:

g. creating a vacuum in the stator windings to boil off and draw out remaining moisture in the stator winding.

8. A method for drying a stator as in claim 5 wherein in step (a) the predetermined low pressure is below the a predetermined high pressure of step (d) by a predetermined pressure difference.

9. A method for drying a stator as in claim 8 wherein the predetermined pressure difference is about 20 p.s.i.

10. A portable hydraulic dryer apparatus for drying a coolant passage within an electrical machine, said apparatus comprising:

a portable frame, an air receiver carried by said frame and having an air outlet couplable to a first port of said coolant passage;

an air compressor carried by said frames and coupled to supply compressed air into said air receiver; and an air pressure actuated valve couplable to a second port of said coolant passage, said valve controlled to open in response to air pressure in the air receiver or coolant passage exceeding a first value and being controlled to close in response to air pressure in the air receiver or coolant passage falling below a second value substantially greater than atmospheric pressure.

11. A hydraulic dryer apparatus as in claim 10 further comprising:

hygrometer sensors couplable to sense the moisture content of air entering and exiting from said coolant passage.

12. A hydraulic dryer apparatus as in claim 10 further comprising:

a vacuum pump carried by said frame and connected via a controllable valve with the outlet of the air receiver such that both are commonly couplable to said first port of the coolant passage.

13. A hydraulic dryer apparatus as in claim 10 wherein said air pressure actuated valve is controlled by an electrical solenoid connected to an electrical switch that responds to an air pressure sensor.

14. A hydraulic dryer apparatus as in claim 10 further comprising:

a second air pressure actuated valve disposed to selectively isolate the air compressor from the air receiver, said second valve being controlled to close in response to air pressure in the air receiver or coolant passage exceeding a predetermined high value and being controlled to open in response to air pressure in the air receiver or coolant passage falling below a predetermined low value.

15. A hydraulic dryer apparatus as in claim 14 wherein said first value is substantially equal to said predetermined high value and said second value is substantially equal to said predetermined low value.

16. A hydraulic dryer apparatus as in claim 14 wherein each of said air pressure actuated valves is controlled by an electrical solenoid connected to an electrical switch that responds to an air pressure sensor.

17. A hydraulic dryer apparatus as in claim 10 further comprising:

an air dryer and air cleaner disposed to dry and clean the air passing into said coolant passage.

18. A stator hydraulic test and dryer apparatus comprising:

an air compressor coupled to supply compressed air to an air receiver through an air dryer;

said air receiver being couplable to a first port of water-cooled stator windings in a generator so that compressed air in said receiver is directed through said first port into said stator windings;

a second port of the stator winding for exhausting pressurized air from the winding;

a hygrometer including sensors, one of said sensors being positioned to monitor the compressed air entering the generator and a second of said sensors being positioned to monitor the air exhausted from said generator, and said hygrometer indicating the comparative dew points of the compressed air entering the generator and that of the air exhausted from the generator.

19. A stator hydraulic test and dryer apparatus as in claim 18 further comprising a pressure outlet flange at a compressed air outlet of said apparatus, said outlet flange being also a vacuum inlet flange coupled to a vacuum pump in said apparatus.

20. A stator hydraulic and dryer apparatus as in claim 18 wherein said air compressor, air dryer, receiver, and first automatic valve are mounted together in a movable frame.

21. A method for automatically drying stator windings using an air compressor, air receiver, hygrometer sensors monitoring compressed air entering and exhausting from the generator, and an automatic pressure activated valve, said method comprising the steps of:

a. automatically closing the pressure activated valve at an air outlet port of the stator windings of the generator, when the pressure in the receiver or stator falls to a predetermined low pressure;

b. providing compressed air from the air compressor to the receiver which passes compressed air into the stator windings of the generator;

c. pressurizing the receiver and stator windings with compressed air;

d. when the pressure in the receiver or stator reaches a predetermined high level, automatically opening the pressure activated valve to exhaust moisture and compressed air from the stator windings and receiver;

e. comparing the dewpoint as measured by the hygrometer sensors of the compressed air entering the generator and the air exhausting from the generator, and concluding the drying method after the difference between the dew points is less than a selected value, and f. repeating steps a through e to dry the stator windings until the method is concluded as set forth in step (e).

22. A stator hydraulic test and dryer apparatus comprising:

an air compressor operatively coupled to supply compressed air to an air receiver through an air dryer and a first automatic valve positioned to isolate said compressor from said air receiver when closed;

said air receiver couplable to a first port of water-cooled stator windings in a generator so that compressed air from said receiver passes into said stator windings;

a second automatic valve coupled to a second port of the stator winding of said generator;

first automatic valve being opened and said second automatic valve being closed when the pressure in said receiver and stator windings is below a predetermined high level;

said first automatic valve being closed and said second automatic valve being opened when the pressure in said receiver and stator windings is at or above said predetermined high level to purge moisture and pressurized air from said receiver and stator windings, and said first automatic valve again being opened and said second automatic valve again being closed when the air pressure in said receiver and stator windings falls to a predetermined low level substantially above atmospheric pressure.

23. A stator hydraulic test and dryer apparatus comprising:

an air compressor having a compressed air outlet operatively couplable to an air receiver through an air dryer and a first automatic valve positioned to isolate said compressor from said air receiver when closed;

said air receiver having an inlet couplable to a first port of a water-cooled stator winding in a generator so that compressed air in said receiver passes into said stator windings;

a second automatic valve couplable to a second port of the stator winding of said generator; and switch means for activating the automatic valves, wherein said first automatic valve is opened and said second automatic valve is closed until the pressure in said receiver and stator windings reaches a predetermined high level, at which point said first automatic valve is closed and said second automatic valve is opened to purge moisture and pressurized air from said receiver and stator windings, said first automatic valve being opened and said second automatic valve being closed when the air pressure in said receiver and stator windings falls to a predetermined low level substantially above atmospheric pressure.

* * * * *